US006676048B1

(12) United States Patent
Tiemann

(10) Patent No.: US 6,676,048 B1
(45) Date of Patent: Jan. 13, 2004

(54) FUEL INJECTOR

(75) Inventor: Carsten Tiemann, Bielefeld (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/701,980

(22) PCT Filed: May 20, 1999

(86) PCT No.: PCT/DE99/01514

§ 371 (c)(1),
(2), (4) Date: Feb. 5, 2001

(87) PCT Pub. No.: WO99/63268

PCT Pub. Date: Dec. 9, 1999

(30) Foreign Application Priority Data

Jun. 4, 1998 (DE) ..... 198 25 028

(51) Int. Cl.[7] ..... A62C 31/02

(52) U.S. Cl. ..... 239/601; 239/533.2; 239/533.12; 239/593; 239/599

(58) Field of Search ..... 239/533.12, 533.2, 239/601, 593, 595, 599, 299; 60/740, 741, 742, 748

(56) References Cited

U.S. PATENT DOCUMENTS

| | | | | | |
|---|---|---|---|---|---|
| 2,583,726 | A | * | 1/1952 | Chalom | 239/601 |
| 3,101,906 | A | * | 8/1963 | Webber | 239/601 |
| 3,521,824 | A | * | 7/1970 | Wilcox | 239/299 |
| 3,638,865 | A | * | 2/1972 | McEneny et al. | 239/424 |
| 4,218,020 | A | * | 8/1980 | Reider | 239/406 |
| 4,638,636 | A | * | 1/1987 | Cohen | 60/740 |
| 4,970,865 | A | * | 11/1990 | Shekelton et al. | 239/533.9 |
| 5,095,696 | A | | 3/1992 | Gulati et al. | |
| 5,109,824 | A | * | 5/1992 | Okamoto et al. | 239/533.12 |
| 5,242,117 | A | * | 9/1993 | D'Agostono et al. | 60/742 |
| 5,244,154 | A | * | 9/1993 | Buchholz | 239/601 |
| 5,346,137 | A | * | 9/1994 | Okamoto et al. | 239/533.12 |
| 5,373,694 | A | * | 12/1994 | Clark | 60/740 |
| 5,515,814 | A | * | 5/1996 | Cooke | 123/3 |
| 5,934,067 | A | * | 8/1999 | Ansart et al. | 60/748 |
| 6,119,459 | A | * | 9/2000 | Gomez et al. | 60/748 |

FOREIGN PATENT DOCUMENTS

| | | | |
|---|---|---|---|
| DE | 2 033 118 | | 1/1972 |
| DE | 27 39 102 | | 3/1979 |
| DE | 32 35 080 | A1 | 3/1984 |
| DE | 97/03853 | | 2/1997 |
| DE | 195 41 303 | A1 | 5/1997 |
| DE | 99/06767 | | 2/1999 |
| FR | 2 428 191 | | 6/1979 |
| GB | 2240137 | * | 7/1991 |

OTHER PUBLICATIONS

Aktive Daempfung selbsterregter Brennkammerschwingungen (AIC) . . ., J. Hermann, D. Vortemer, S. Gleis, VDI–Berichte Nr. 1090, 1993.

Gutmark et al: "Flow and Acoustic Features . . . ", Experiments in Fluids, vol. 13, Nr. 1, pp. 49–55.

* cited by examiner

*Primary Examiner*—Dinh Q. Nguyen
(74) *Attorney, Agent, or Firm*—Eckert Seamans Cherin & Mellott, LLC

(57) ABSTRACT

The invention relates to a fuel injector having an orifice region in which an orifice passage extends along an injector axis and ends at an orifice edge. The fuel injector is characterized in that the orifice edge is rotationally asymmetrical about the injector axis.

11 Claims, 4 Drawing Sheets

FUEL INJECTOR

BACKGROUND

1. Filed of the Invention

The invention relates to a fuel injector having an orifice region in which an orifice passage extends along an injector axis. The fuel injector is suitable in particular for liquid fuel.

2. Related Art

Described in DE 32 35 080 A1 is a spill-type injector in which two liquid feeds opposed to one another open tangentially into a circular-cylindrical swirl space. An injection passage on the one hand and, in opposition thereto, a return bore on the other hand are connected to the swirl space. The spill-type injector is suitable in particular for the atomization of liquid fuel in gas-turbine combustion chambers. Atomization is achieved by virtue of the fact that fuel flows tangentially into the swirl chamber and is combined to form a main flow, in the course of which a swirl is imparted to the main flow by circular guidance in the swirl chamber, this swirl being maintained in the injection passage. As a result, the fuel jet fans out conically during the discharge of the fuel from the injection passage. On the other hand, fuel is returned via the return bore. While maintaining a constant fuel inflow to the spill-type injector, the quantity of injected fuel is controlled by the quantity of returned fuel being set.

In the article "Aktive Dämpfung selsterregter Brennkammerschwingungen (AIC) bei Druckzersäuberbren-nern durch Modulation der flüssigen Brennstoffzufuhr" [Active damping of self-excited combustion-chamber vibrations (AIC) in the case of pressure-atomizer burners by modulation of the liquid fuel feed] by J. Hermann, D. Vortmeyer and S. Gleis, VDI-Berichte No. 1090, 1993, it is described how a combustion vibration is generated in the combustion chamber of a gas turbine or a boiler and how it can be actively damped. This is because the abovementioned self-excited combustion vibration behavior, which is also referred to as combustion instability, can occur during combustion in the combustion chamber. Such a combustion vibration is generated by the interaction between a fluctuating heat release during combustion and the acoustics of the combustion chamber. A combustion vibration is often accompanied by a high emission of noise and mechanical loading of the combustion chamber, which may lead to destruction of components.

DE-A 20 33 118 shows a gas burner for a gas-fired smelting furnace. In order to create a high flame temperature, the gas burner has an injector which is in the form of a gap and converges in the region of the orifice. A high heat concentration is thereby ensured.

SUMMARY OF THE INVENTION

The object of the invention is to specify a fuel injector by means of which a combustion vibration is at least reduced.

According to the invention, this object is achieved by a fuel injector having an orifice region in which an orifice passage extends along an injector axis and ends at an orifice edge in a non-convergent manner, the orifice edge being rotationally asymmetrical about the injector axis.

Fuel is directed in the fuel injector through the orifice region in the orifice passage. The orifice passage is designed to be non-convergent in the orifice region, that is to say it does not narrow, so that no pressure loss occurs. The fuel discharges from the orifice passage at the orifice edge into the exterior space. In the process, the jet widens, i.e. a divergent, fanned-out fuel jet is obtained. Owing to the fact that the orifice edge is rotatationally asymmetrical about the injector axis, the divergent fuel jet is also rotationally asymmetrical. A distorted fuel cone is thus obtained, and this distorted fuel cone has a different extent perpendicular to the jet direction at least in two spatial directions. The spatial zone in which the combustion takes place is distorted in a corresponding manner. This distortion of the combustion zone influences the generation of a combustion vibration. The zone of the combustion is displaced and spread in such a way that the acoustic system of burner and burner surroundings is detuned. The fuel injector and thus the discharging fuel cone are oriented in such a way that a reduction in the combustion vibrations right up to complete suppression of the combustion vibrations is obtained.

The orifice edge is preferably asymmetrical about the injector axis. This means that the orifice edge must undergo a complete revolution about the injector axis in order to coincide again with its original position.

In one embodiment the orifice edge preferably has twofold symmetry. In this case, the orifice edge is more preferably an ellipse or a rectangle, preferably with rounded-off corners.

The twofold symmetry means that the orifice edge must undergo half a revolution, i.e. 180°, in order to coincide with its original position.

In a second embodiment the orifice edge preferably corresponds to a contour which is formed by a rectangle and a circle, the circle lying with its center on the centroid of the rectangle and extending beyond the narrow side of the rectangle, and the contour enclosing the outer edge of the rectangle and the circle.

In a third embodiment the orifice edge preferably corresponds to a contour which is formed by two rectangles which are perpendicular to one another and have a common centroid, the contour enclosing the outer edge of both rectangles.

In a fourth embodiment the orifice passage preferably has a passage wall, each point of the passage wall being at a distance from the injector axis and having an axial position along the injector axis, the distance from the axis for at least two points on the passage wall which have the same axial position being different. The distance from the axis for points on the passage wall having the same axial position more preferably changes continuously in a circumferential direction about the injector axis. The orifice passage is thus rotationally asymmetrical about the injector axis. The fuel is thus already directed for a short distance in the orifice region in a rotationally asymmetrical flow. A rotationally asymmetrical form is thus imposed on the fuel flow and leads in an especially efficient manner to the formation of a rotationally asymmetrical, distorted fuel cone during the discharge of the fuel from the fuel injector. In a fifth embodiment the orifice passage preferably widens toward the orifice edge.

In still another embodiment the orifice edge preferably has a notch. Due to such a notch, fuel is deflected to a greater extent in the direction of the notch than in the other directions of the orifice edge during the discharge from the fuel injector. Such a notch in turn therefore achieves the effect that fuel is not deflected to an equally pronounced degree in all spatial directions. A distorted fuel cone is likewise formed.

The fuel injector of this invention is preferred for liquid fuel, in particular crude oil. The fuel injector is preferably used in a burner for a gas turbine, in particular for a stationary gas turbine.

BRIEF DESCRIPTION OF THE DRAWINGS

The invention is explained in more detail by way of example and partly schematically with reference to the drawings; in which.

The same reference numerals have the same meaning in the various figures.

DESCRIPTION OF THE EMBODIMENT

Figure 1:
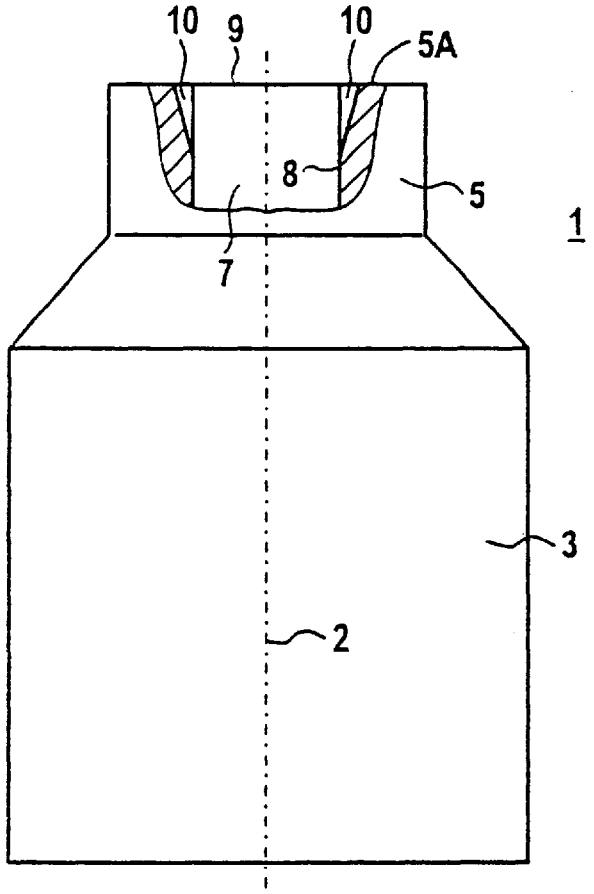
FIG. 1 shows the side view of a fuel injector.

FIG. 1 shows the side view of a fuel injector 1. A cylindrical injector body 3 narrows in a frustoconical section to a likewise cylindrical orifice region 5 having an end face 5A. Directed along an injector axis 2, an orifice passage 7 runs in the fuel injector 1 and opens at the end of the orifice region 5 with an orifice edge 9. The orifice region 5 is sectioned at right angles so that a bevel 10 of the passage wall 8 of the orifice passage 7 can be seen. Due to this bevel 10, the orifice 30 edge 9 is rotationally asymmetrical about the injector axis 2. This becomes clear in FIG. 2.

Figure 2:
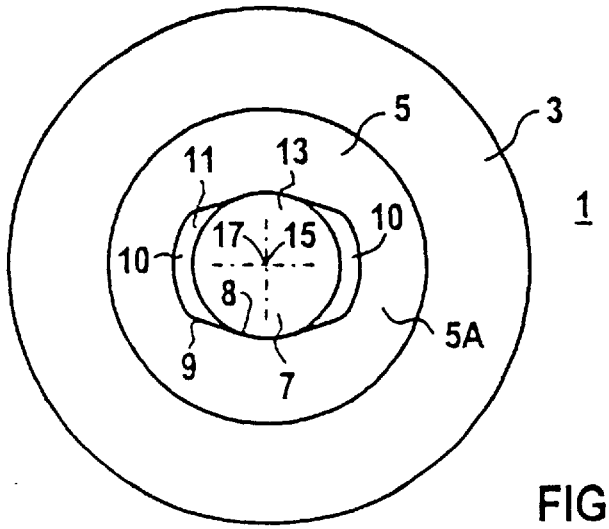
FIG. 2 shows the plan view of the fuel injector of FIG. 1.

FIG. 2 shows a plan view of the fuel injector 1 from FIG. 1. The orifice edge 9 is given twofold symmetry by two bevels 10 of the passage wall 8 located opposite one another. The orifice edge 9 therefore corresponds to a contour which is formed by the outer edge of a rectangle 11 and a circle 13, the circle 13 lying with its center 15 on the centroid 17 of the rectangle 11 and extending beyond the narrow side of the rectangle 11.

Owing to the fact that the orifice edge 9 is rotationally asymmetrical about the injector axis 2, a rotationally asymmetrical, distorted fuel cone 33 (also see FIG. 4) forms during discharge of fuel from the fuel injector 1. This distorted fuel cone 33 leads to the zone of the combustion likewise being distorted. By suitable orientation of the fuel injector 1, an acoustic interaction between the fuel injector 1 and its surroundings can be detuned in such a way that at most only slight combustion vibrations form. Such suppression of combustion vibrations is possible in an especially effective manner if a plurality of fuel injectors 1 are arranged in a combustion chamber. Such fuel injectors 1 are preferably used in burners for gas turbines. The large-volume, high-energy combustion in gas turbines can cause combustion vibrations which cause not only a considerable noise nuisance but also material damage.

In addition, the fuel injector 1 has a favorable effect on a reduction in nitrogen oxides. A better fine distribution of fuel can be achieved by the distorted fuel cone. In particular, a small droplet size for the fuel is obtained. The better distribution and the small droplet size of the fuel results in the flame temperatures of the combustion becoming more uniform. As a result, the maximum temperatures achieved, which to a considerable extent determine the production of nitrogen oxides, are not so high. Furthermore, better intermixing with water, sprayed in simultaneously as and when required, is obtained. Water is injected to reduce flame temperatures in the combustion, as a result of which the formation of nitrogen oxides is reduced. In the case of a rotationally asymmetrical fuel cone 33 (see FIG. 4), better intermixing of fuel and water is obtained.

Figure 3:
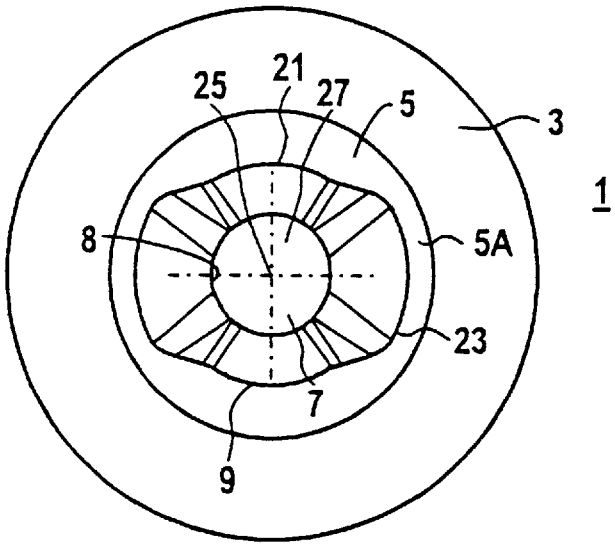
FIG. 3 shows a plan view of a further fuel injector.

A plan view of a fuel injector 1 is shown ink FIG. 3. The difference from the fuel injector 1 from FIGS. 1 and 2 consists in the fact that the orifice edge 9 constitutes a contour which is formed by a rectangle 21 and a rectangle 23 perpendicular thereto. The two rectangles 21, 23 have a common centroid 25, 27.

Figure 4:
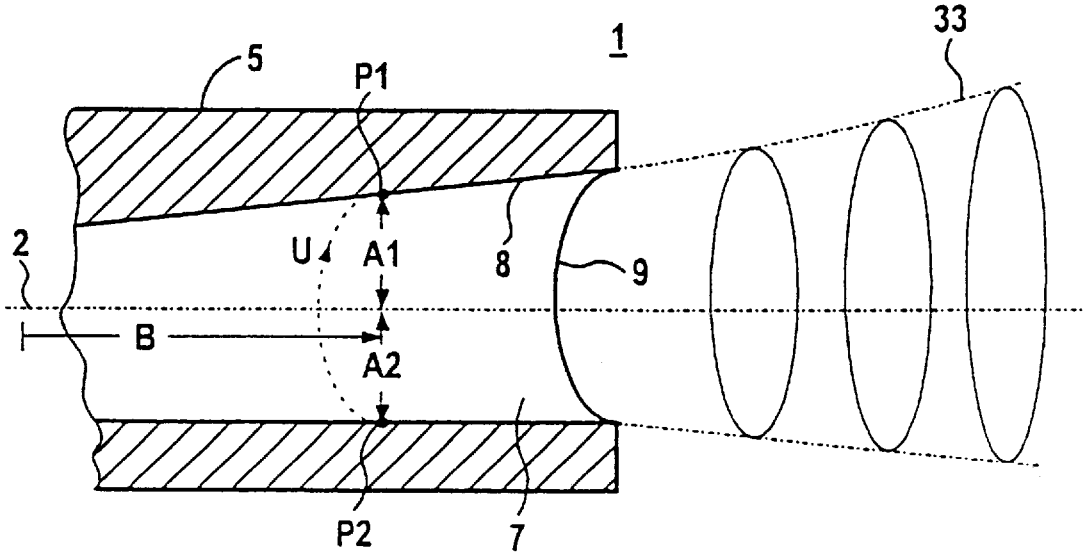
FIG. 4 shows a longitudinal section through the orifice region of a fuel injector.

A longitudinal section through the orifice region 5 of a fuel injector 1 is shown in FIG 4. The fuel passage 7 widens toward the orifice edge 9. Two opposite points P1, P2 on the passage wall 8 have an axial position B along the injector axis 2 relative to a zero position selected at random. Point P1 is at a distance A1 from the injector axis 2. Point P2 is at a distance A2 from the injector axis 2. The distance A1 is greater than the distance A2. In a circumferential direction U about the injector axis 2, that is for points P on the passage wall 8 which all have the same axial position B along the injector axis 2, the respective distance A from the injector axis 2 changes continuously. A rotationally asymmetrical form is imposed on a fuel flow in the orifice passage 7. This manifests itself in a rotationally asymmetrical, distorted fuel cone 33 during discharge of the fuel from the orifice passage 7. This results in the abovementioned advantages with regard to the suppression of combustion vibrations and the reduction in nitrogen-oxide emissions.

Figure 5:
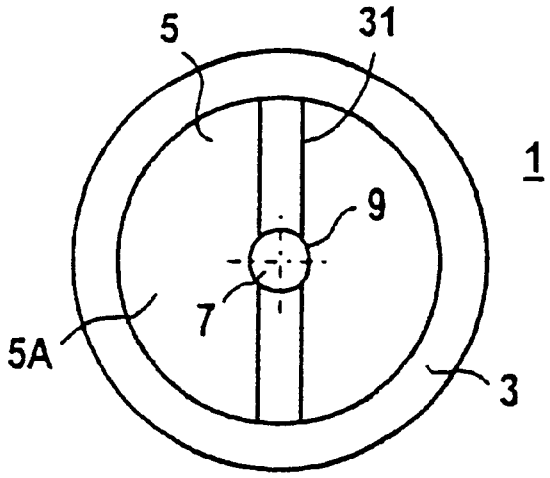
FIG. 5 shows a plan view of a further fuel injector.
Figure 6:
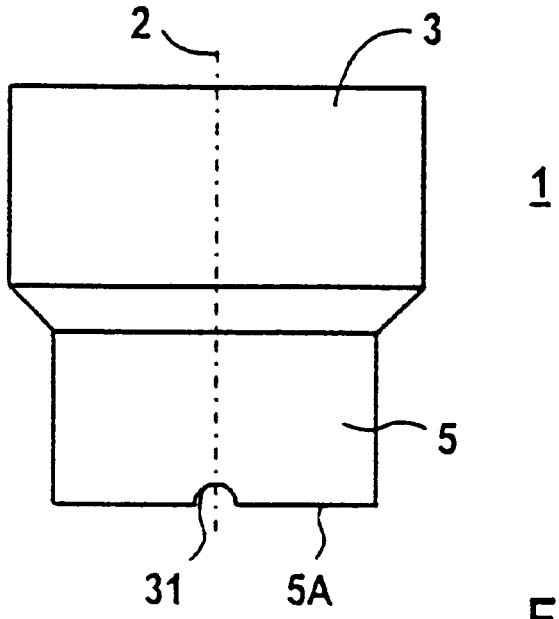
FIG. 6 shows a side view of the fuel injector from FIG. 5.

FIG. 5 shows a plan view of a fuel injector 1. FIG. 6 shows the fuel injector of FIG. 5 in a side view. A semicylindrical notch 31 is milled or sawn in the end face 5A of the orifice region 5 and intersects the orifice of the orifice passage 7. As a result, the orifice edge 9 likewise has a notch 31. Fuel is sprayed laterally in an especially wide pattern at this notch 31. This results in a rotationally asymmetrical fuel cone 33 for the fuel discharging from the fuel injector 1. This in turn results in the advantages already mentioned for the reduction in combustion vibrations and nitrogenoxide emissions.

Figure 7:
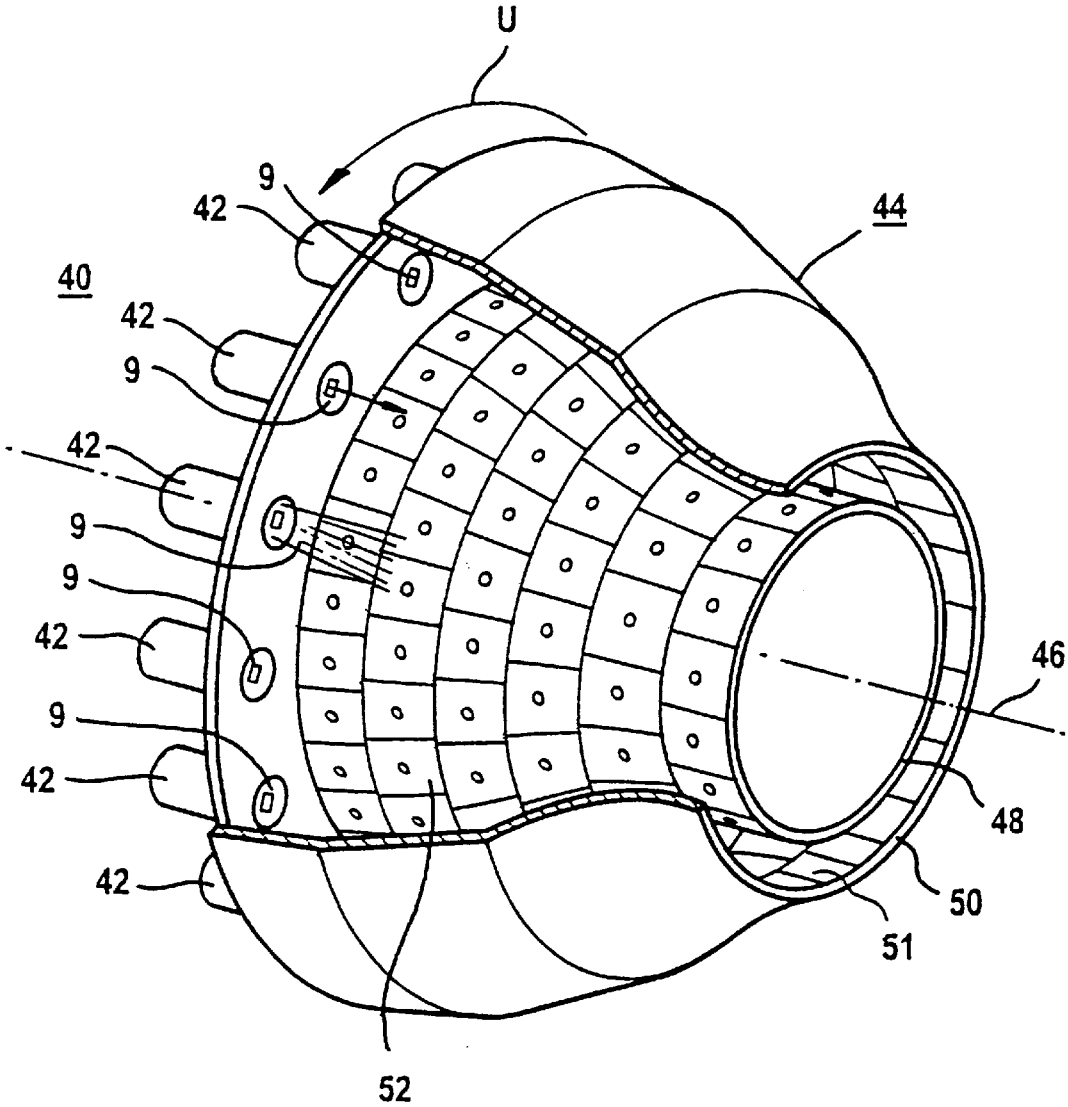
FIG. 7 shows a burner arrangement in an annular combustion chamber.

FIG. 7 shows a burner arrangement 40 consisting of a multiplicity of burners 42 in an annular combustion chamber 44 of a gas turbine (not shown in any more detail). The annular combustion chamber 44 is rotationally symmetrical about a combustion-chamber axis 46. It has an inner wall 48 and an outer wall 50, which enclose an annular space 51. The inside of the outer wall 50 and the outside of the inner wall 48 are provided with a refractory lining 52.

The orifice edges 9 of the burners 42 are rotationally asymmetrical and are oriented irregularly relative to one another. This results in a reduced tendency to form a combustion vibration, since the combustion vibrations originating from the individual burners 42 are irregularly superimposed on one another and largely extinguish one another in the process.

What is claimed is:

1. A fuel injector for injecting liquid fuel into a gas turbine, comprising an orifice region in which an elongated, continuous orifice passage extends in a non-convergent manner along its entire length from a fuel source along an injector axis and ends at an orifice edge for the fuel to be discharged from said orifice passage at said orifice edge into the exterior space, so no pressure loss occurs, the orifice edge defining an opening that is rotationally asymmetrical about the injector axis, with the opening narrowing at elongated ends thereof in a plane substantially perpendicular to the injector axis and having the center of the opening laying on the injector axis.

2. The fuel injector as claimed in claim 1, characterized in that the elongated opening in the orifice edge has maximum width, measured perpendicular to an elongated dimension of the opening, substantially at a center of the opening.

3. The fuel injector as claimed in claim 2, characterized in that the orifice edge opening is a rectangle, in particular with rounded-off corners.

4. The fuel injector as claimed in claim 1, characterized in that the orifice edge has twofold symmetry.

5. The fuel injector as claimed in claim 1, characterized in that the orifice passage widens toward the orifice edge.

6. A gas turbine fuel injector for liquid fuel, having an orifice region in which an elongated orifice passage extends in a continuous non-convergent manner from a fuel source along an injector axis and ends at an orifice edge for the fuel to be discharged from said orifice passage at said orifice edge into the exterior space, so no pressure loss occurs, characterized in that the entire orifice edge opening in a plane substantially perpendicular to the injector axis is an ellipse with its center laying on the injector axis.

7. A gas turbine fuel injector for liquid fuel, having an orifice region in which an elongated orifice passage extends along an injector axis and ends at an orifice edge in a non-convergent manner, characterized in that the orifice edge is rotationally asymmetrical about the injector axis and corresponds to a contour which is formed by a rectangle and a circle, the circle lying with its center on the centroid of the rectangle and extending beyond the narrow side of the rectangle, and the contour enclosing the outer edge of the rectangle and the circle.

8. A gas turbine fuel injector for liquid fuel, having an orifice region in which an elongated orifice passage extends along an injector axis and ends at an orifice edge in a non-convergent manner, characterized in that the orifice edge is rotationally asymmetrical about the injector axis and the orifice edge corresponds to a contour which is formed by two rectangles which are perpendicular to one another and have a common centroid, the contour enclosing the outer edge of both rectangles.

9. A gas turbine fuel injector for liquid fuel, having an orifice region in which an elongated orifice passage extends along an injector axis and ends at an orifice edge in a non-convergent manner, characterized in that the orifice edge is rotationally asymmetrical about the injector axis and the orifice passage has a passage wall, each point of the passage wall being at a distance from the injector axis and having an axial position along the injector axis, the distance from the axis for at least two points on the passage wall which have the same axial position being different.

10. The fuel injector as claimed in claim 9, characterized in that the distance from the axis for points on the passage wall having the same axial position changes continuously in a circumferential direction about the injector axis.

11. A gas turbine fuel injector for liquid fuel, having an orifice region in which an elongated orifice passage extends in a continuous non-convergent manner from a fuel source along an injector axis and ends at an orifice edge for the fuel to be discharged from said orifice passage at said orifice edge into the exterior space, so no pressure loss occurs, characterized in that the orifice edge is rotationally asymmetrical about the injector axis and the orifice edge has a notch on diametrically opposite sides of the orifice edge, which diameter substantially intersects the injector axis.

* * * * *